United States Patent [19]

Takechi et al.

[11] 4,391,653

[45] Jul. 5, 1983

[54] PROCESS FOR PRODUCING COLD ROLLED STEEL STRIP HAVING EXCELLENT MECHANICAL STRENGTH AND USEFUL FOR MOTOR VEHICLES

[75] Inventors: Hiroshi Takechi; Hiroshi Katoh, both of Kisarazu; Kazuo Koyama, Kimitsu; Kazuhide Usami, Kisarazu, all of Japan

[73] Assignee: Nippon Steel Corporation, Tokyo, Japan

[21] Appl. No.: 302,450

[22] Filed: Sep. 15, 1981

[30] Foreign Application Priority Data

Sep. 25, 1980 [JP] Japan ..... 55/132344

[51] Int. Cl.[3] ..... C21D 8/04

[52] U.S. Cl. ..... 148/12 C; 148/12.4

[58] Field of Search ..... 148/36, 12 C, 12.4

[56] References Cited

U.S. PATENT DOCUMENTS 3,839,095 10/1974 Kubotera et al. ..... 148/12 C
3,897,280 7/1975 Gondo et al. ..... 148/12 C
3,988,173 10/1976 Kawano ..... 148/36

FOREIGN PATENT DOCUMENTS 55-54526 4/1980 Japan ..... 148/12 C

*Primary Examiner*—Peter K. Skiff
*Attorney, Agent, or Firm*—Kenyon & Kenyon

[57] ABSTRACT

A high strength cold rolled strip having excellent deep drawability and resistance to deterioration by natural aging and to planar cracking and useful for motor vehicles, is produced by hot rolling a steel slab comprising 0.008–0.020% by weight of C,
0.01–0.45% by weight of Mn,
0.05–0.10% by weight of P,
0.005–0.050% by weight of acid-soluble Al, and the balance consisting of Fe and unavoidable impurities in which N is limited to a content of 40 ppm or less, at a temperature of 1200° C. or less but not lower than the $Ar_3$ point of the steel slab; by cold rolling the resultant steel strip at a rolling reduction of 65% or more; by continuously annealing the cold rolled steel strip at a temperature of from 700° to 900° C. for 20 seconds to 3 minutes; by cooling the steel strip at a cooling rate of 5° C./sec or more; by overaging the annealed steel strip at a temperature of from 320° to 450° C. for 1 to 10 minutes; by cooling said overaged steel strip to the ambient temperature, and, finally; by temper-rolling the cooled steel strip at the ambient temperature.

5 Claims, No Drawings

PROCESS FOR PRODUCING COLD ROLLED STEEL STRIP HAVING EXCELLENT MECHANICAL STRENGTH AND USEFUL FOR MOTOR VEHICLES

FIELD OF THE INVENTION

The present invention relates to a process for producing a steel strip having an excellent mechanical strength and useful for motor vehicles. More particularly, the present invention relates to a process for producing a cold rolled, phosphorus-containing steel strip having not only and excellent mechanical strength but also an excellent formability, an excellent anti-aging property and a superior hardening property in paint-baking, produce and useful for motor vehicles.

BACKGROUND OF THE INVENTION

In recent years, there has been a strong demand for making motor vehicles light weight. For this purpose, types of materials for producing the motor vehicles are widely being changed. Especially, the conventional soft steel sheets are positively substituted by high strength steel sheets in the automobile industry, because the abovementioned substitution is very easy and effective for making motor vehicles light weight. Also, it is positively promoted to enhance the quality of the high strength steel sheets.

It is known that the mechanical strength of the steel strip is enhanced at a low cost by adding phosphorus into the steel strip so as to a form a phosphorus solid solution therein. This addition of phosphorus is often used in the production of sheet steel of which excellent toughness is not demanded. The principal technique of the abovementioned enhancement of the mechanical strength of the steel strip is disclosed in Japanese Patent Application Publication No. 50-31090. This type of technology is effective for enhancing only the mechanical strength of the steel sheet. Therefore, the resultant steel sheet having an enhanced mechanical strength is useful for the safety of motor vehicles.

However, in recent years, the motor vehicles are required to exhibit various enhanced properties other than mechanical strength. Therefore, high strength steel strips are demanded to have various enhanced properties in addition to the excellent mechanical strength thereof.

In the production of motor vehicles, sheet steels are mostly used in the production of panels, including outside panels and inside panels, of the vehicles. The steel sheet to be used for making panels is required to exhibit a low yield strength (YS), substantially no yield-point elongation (or Lüder's elongation), an excellent stretchability and an excellent deep drawability. Also, it is important that the above-mentioned properties of the sheet steel are not deteriorated by natural aging. Further, it is necessary that the sheet steel exhibits a satisfactory resistance to denting. The term "denting property" refers to an oil canning property of the sheet steel and the intensity of denting property of the panel of the motor vehicle is variable depending on the yield strength and thickness of the sheet steel which has been shaped into the desired panel, painted and baked. When a thin sheet is used in order to make the panels of the motor vehicles light weight, the resultant panels exhibit an unsatisfatory resistance to denting. Therefore, it is advantageous that the panels are made from high strength steel strips which exhibit an excellent resistance to denting. High strength steel strips to be used for the above-mentioned use, should exhibit a low yield strength, a high elongation and substantially no yield-point elongation, an excellent resistance in the above-mentioned properties to natural aging and a superior hardening property in paint-baking procedure.

The paint-baking procedure is carried out at a temperature of at the highest 200° C. The hardening phenomenon of the steel strips at the above-mentioned low paint-baking temperature occur only by the formation of carbon and/or nitrogen atmosphere, or precipitation of carbide and/or nitride.

However, the carbon and nitrogen solid solutions can easily diffuse at room temperature and, therefore, cause the resistance of the steel strip to natural aging to deteriorate. Accordingly, it is necessary to minimize the deterioration in the resistance to aging of the steel strip at room temperature while maintaining the hardening property of the steel strip at the paint-baking temperature at a satisfactory level. The activation energy necessary for diffusion of carbon is larger than that of nitrogen. Therefore, usually, nitrogen is fixed in an aluminium killed steel and a portion of carbon is converted to a carbon solid solution in the steel. However, the upper limit of the equilibrium solubility of the carbon in the steel at room temperature is extremely low. Therefore, it is extremely difficult to over-saturate the steel with the carbon solid solution in an amount necessary to obtain a satisfactory hardening property at the paint-baking temperature, by the usual slow cooling procedure in a conventional box-annealing process. Accordingly, it is advantageous that the steel strip is subjected to a continuous annealing procedure which is effective for retaining the carbon solid solution in an over-saturated condition in the steel strip even after an over-aging procedure is applied to the steel strip.

A prior art concerning a process for producing a phosphorus-added steel strip by using a continuous annealing procedure, is disclosed in Japanese Patent Application Publication No. 5427819 (1979). However, the product of the prior art is not satisfactory in certain properties, as a high strength steel strip useful for motor vehicle panels. For example, the resultant steel strip of the prior art exhibits a poor Lankford's value ($\bar{r}$ value) which closely relates to the deep drawability of the steel strip. In order to enhance the $\bar{r}$ value of the steel strip it is necessary to apply a two time—cold rolling—annealing process to the steel strip. For another example, the resultant steel strip of the prior art exhibits a poor resistance to aging at room temperature and, therefore, the aging causes the yield strength of the steel strip to be elevated and the yield-point elongation to increase. Therefore, this type of steel strip of the prior art exhibits a poor formability. Even if the steel strip can be shaped by drawing or pressing, the resultant shaped product exhibits a surface defect, that is a so-called stretcher strain.

It is known that a conventional steel strip having a low content of carbon and a low content of manganese, that is, a conventional low carbon-low manganese steel strip, exhibits a high $\bar{r}$ value. However, when phosphorus is added to this type of steel strip, the resultant phosphorus-added steel strip exhibits a decreased resistance to brittle fracture during press forming, or after press forming. This feature is so-called planar cracking. The intensity of such the brittle fracture of the steel strip increases with the decrease in the content of carbon and with the increase in the content of phosphorus. Therefore, there is a limit in decreasing the content of carbon in the steel strip. Also, the excessively low content of carbon results in a poor mechanical strength of the steel strip.

SUMMARY OF THE INVENTION

An object of the present invention is to provide a process for producing a high strength cold rolled steel strip having an excellent mechanical strength and a superior formability and, therefore, useful for motor vehicles.

Another object of the present invention is to provide a process for producing a high strength cold rolled steel strip having an excellent anti-aging property and a superior bake-hardening property in addition to excellent mechanical strength and superior formability and, therefore, useful for motor vehicles.

The above-mentioned objects can be attained by the process of the present invention for producing a high strength cold rolled steel strip useful for motor vehicles, which process comprises the steps of:

preparing a steel slab comprising 0.008 to 0.020% by weight of carbon, 0.01 to 0.45% by weight of manganese, 0.05 to 0.10% by weight of phosphorus, 0.005 to 0.050% by weight of acid-soluble aluminium and the balance consisting of iron and unavoidable impurities in which nitrogen is limited to a content of 40 ppm or less;

heating the steel slab to a temperature of 1200° C. or less;

hot rolling the heated steel slab at a temperature not lower than the $Ar_3$ point of the steel slab;

descaling the resultant hot rolled steel strip;

cold rolling the descaled steel strip at a rolling reduction of 65% or more;

continuously annealing the cold rolled steel strip by heating it to a temperature of from 700 to 900° C., by soaking the steel strip for 20 seconds to 3 minutes, and by cooling the steel strip at a cooling rate of 5° C./sec or more;

overaging the annealed steel strip at a temperature of from 320 to 450° C. for 1 to 10 minutes;

cooling the overaged steel strip to an ambient temperature, and;

temper-rolling the cooled steel strip at the ambient temperature.

The steel slab may contain an optional alloying component consisting of at least one member selected from the group consisting of 0.0005 to 0.0050% by weight of boron, 0.5% by weight or less of silicon, 0.005 to 0.020% by weight of at least one rare earth metal and 0.0005 to 0.0050% by weight of calcium.

DETAILED DESCRIPTION OF THE INVENTION

In the process of the present invention, the steel slab to be processed comprises, as indispensable alloying elements, 0.008 to 0.020% by weight of carbon, 0.01 to 0.45% by weight, preferably, 0.01 to 0.20% by weight, of manganese, 0.05 to 0.10% by weight of phosphorus, 0.005 to 0.050% by weight of acid-soluble aluminium, the balance consisting of iron. In the unavoidable impurities contained in the steel slab, the content of nitrogen is limited to 40 ppm or less, preferably, 20 ppm or less.

The effects of the indispensable alloying components except for iron on the property of the resultant high strength cold rolled steel strip are as follows.

Carbon

Usually, the addition of phosphorus to the steel strip causes the planar cracking of the steel strip to be more pronounced. Carbon is effective for enhancing the resistance of the phosphorus-added steel strip to planar cracking. For this effect, it is necessary that the content of carbon in the steel trip is at least 0.008% by weight. However, the addition of an excessive amount of carbon causes the Lankford's value, r of the resultant steel strip to be unsatisfactorily low. Therefore, the content of carbon in the phosphorus-added steel strip should not exceed 0.02% by weight.

Manganese

Manganese is effective for fixing sulfur and for preventing hot embrittlement of the steel strip. For this effect, it is necessary that the content of manganese in the steel strip is at least 0.01% by weight. However, the addition of an excessive amount of manganese causes the resultant steel strip to exhibit an unsatisfactory $\bar{r}$ value even if the content of carbon is low, for example, less than 0.02% by weight. In order to obtain a satisfactory high $\bar{r}$ value of the steel strip, it is necessary that the content of manganese does not exceed 0.45% by weight, preferably, 0.2% by weight.

Phosphorus

Phosphorus is a strengthening element effective for increasing the mechanical strength of the steel strip. In order to attain this effect, the content of phosphorus should be at least 0.05% by weight. However, the excessive increase in the content of phosphorus results in an undesirable increase in planar cracking of the resultant steel strip. This phenomenon remarkably appears in the low carbon steel strip like that of the present invention. Accordingly, the content of phosphorus should not exceed 0.1% by weight.

Acid-soluble aluminium

Aluminium is effective for enhancing deoxidation of the steel strip and for fixing nitrogen by converting it to AlN. In order to attain the above-mentioned effect, it is necessary that the content of acid-soluble aluminium in the steel strip is at least 0.005% by weight. However, an excessively large content of aluminium undesirably causes an increase in the content of the aluminium oxide type impurity in the resultant steel strip and, therefore, the degree of cleanness of the steel strip becomes poor. Therefore, it is necessary that the content of acid-soluble aluminium does not exceed 0.050% by weight.

In the steel slab usable for the process of the present invention, the content of nitrogen is limited to 40 ppm or less. Nitrogen which is in the form of a solid solution in a non-annealed or annealed steel strip, causes the texture of the steel strip to deteriorate and the age brittlement of the steel strip to be accelerated. Therefore, nitrogen should be fixed by aluminium to form AlN. In order that nitrogen is completely fixed, it is necessary that the content of nitrogen is 40 ppm or less. When the content of nitrogen is larger than 40 ppm, the excessive amount of nitrogen is retained in the form of a solid solution in the steel strip. In order to completely fix nitrogen into the form of A n, it is preferable that the content of nitrogen does not exceed 20 ppm.

The steel slab usable for the process of the present invention may contain, as an optional alloying component, at least one member selected from the group consisting of:

0.0005 to 0.0050% by weight of boron; 0.5% by weight or less of silicon; 0.005 to 0.020% by weight of at least one rare earth metal, and; 0.0005 to 0.0050% by weight of calcium.

The function of the above-mentioned elements is as follows.

Boron

Boron is effective for fixing nitrogen before the steel strip is subjected to a hot rolling procedure. This fixing effect can be attained when the content of boron is 0.0005% by weight or more. However, the content of boron above 0.0050% by weight undesirably promotes the hot embrittlement of the resultant steel strip. Therefore, it is necessary that the content of boron does not exceed 0.0050% by weight.

Calcium

In case of a low manganese steel strip, sometimes, sulfur in the steel strip is not completely fixed by manganese to form MnS. In this case, calcium is effective for fixing sulfur. In order to attain the above-mentioned sulfur-fixing effect, it is necessary that the content of calcium is 0.0005% by weight or more. However, an excessive amount of calcium above 0.0050% by weight results in the formation of a large amount of oxide type impurities in the steel strip and causes the degree of cleanness of the steel strip to be poor. Therefore, it is necessary that the content of calcium does not exceed 0.0050% by weight.

Rare earth metals the rare earth metals exhibit the same effects as those of calcium. In order to attain the effect, it is necessary that the content of the rare earth metals is 0.005% by weight or more. However, in order to maintain the cleanness of the steel strip at a satisfactory degree thereof, it is necessary that the content of the rare earth metals does not exceed 0.020% by weight.

Silicon

Silicon is effective for strengthening the steel strip. However, an excessive amount of silicon causes chemical treatment-accepting property and resistance to corrosion under paint of the steel strip to deteriorate. Therefore, the content of silicon should not exceed 0.5% by weight.

When an Al-Si killed steel containing a relatively large amount of silicon is used, sometimes, it is difficult to stably apply a pre-treatment (under treatment) for an anionic electrodeposition coating or cationic electrodeposition coating onto the surface of the steel strip. Therefore, for the process of the present invention it is preferable to use an aluminium killed steel strip into which silicon is not positively added.

The preparation of the steel slab can be effected by any conventional slab-making methods, that is, a method of making the steel slab from ingot or a continuous casting method. In the process of the present invention, the specific steel slab is heated to a temperature of 1200° C. or less and hot rolled at a temperature not below the $Ar_3$ point of the steel slab. The specified heating temperature of 1200° C. or less is effective for allowing harmful impurities such as nitrogen and sulfur to precipitate in the harmless form of coarse grains of AlN and MnS as large as possible. In order to attain the above-mentioned contribution, it is preferable that the heating temperature for the steel slab is 1130° C. or less. Also, the heating temperature for the steel slab is selected so that the temperature of the steel slab does not come below the $Ar_3$ point of the steel slab while the steel slab is hot rolled. Usually, it is preferable that the heating temperature is not below 1000° C.

The hot rolling procedure for the heated steel slab is carried out at a temperature corresponding to that $Ar_3$ transformation point of the steel slab or less. When the hot rolling temperature is lower than the $Ar_3$ point of the steel slab, the surface of the resultant hot rolled steel strip has coarse grains which causes the quality of the steel strip after a cold rolling and annealing procedures are applied thereto to be significantly deteriorated.

The coiling temperature of the hot rolled steel strip is not limited to a specific range of temperature. However, in order to complete the precipitation which has not been completed in the heating and hot rolling procedures, it is preferable that the hot rolled steel strip is coiled at a temperature of 650° C. or more but not exceeding 750° C. When exceeding 750° C., the resultant steel strip sometimes exhibits a remarkably degraded adaptability for the pickling procedure.

the hot rolled steel strip is descaled by a conventional descaling method and, then, cold rolled at a rolling reduction of 65% or more. When the rolling reduction is smaller than 65%, the resultant cold rolled steel strip exhibits an unsatisfactory $\bar{r}$ value.

In the case where a conventional steel strip is cold rolled, the excessively large rolling reduction causes the resultant cold rolled steel strip to exhibit a decreased $\bar{r}$ value. Therefore, the cold rolling procedure is carried out usually at a rolling reduction of about 60 to 70%. However, in the case of the present invention, since the specific phosphorus-added steel strip contains specific amounts of carbon and manganese and the hot rolling procedure is carried out under a specific condition, the larger the rolling reduction up to about 90%, the larger the r value. Therefore, it is possible to carry out the cold rolling procedure at a high rolling reduction of 65% or more. In order to obtain a high $\bar{r}$ value of 1.5 or more similar to that of the usual deep drawing cold rolled steel strip, it is preferable that the total rolling reduction is 75% or more.

The cold rolling procedure may be a usual symmetric rolling procedure or an asymmetric rolling procedure. The cold rolled steel strip is subjected to a continuous annealing procedure. In this annealing procedure, the cold rolled steel strip is continuously heated to a desired annealing temperature of from 700 to 900° C., the temperature of the cold rolled steel strip is soaked for 20 seconds to 3 minutes, and, then, rapidly cooled at a cooling rate of 5° C./sec or more to a desired overaging temperature.

When the annealing temperature is lower than 700° C., a recrystallization of the steel strip is effected incompletely and the resultant product exhibits a poor elongation in view of the resultant tensile strength thereof. When the annealing temperature is more than 900° C., an undesirably excessive amount of austenite is produced in the steel strip and the texture of the steel strip is deteriorated. When the annealing time is less than 20 seconds, the recrystallization is incomplete. Also, an annealing time of more than 3 minutes causes the crystal grains in the steel strip to excessively grow and to be coarse. Furthermore, when the cooling rate is less than 5° C./sec, the degree of oversaturation of carbon in the resultant steel strip is unsatisfactorily low in order to obtain the necessary precipitation of carbon in the next overaging procedure.

The rapid cooling procedure can be effected by any conventional cooling methods, for example, a gas-jet method, a gas-water jet method, a metallic roll contacting method, a hot water-quenching method, or a water-quenching method.

In the cooling procedure, it is preferable that the cooling rate at a temperature range of 650° C. or more is 30° C./sec or less, whereas the cooling rate in a temperature range below 650° C. may be more than 30° C./sec. This is because in the temperature range above 650° C., the cooled steel strip passes through certain transformation points, and in these points the excessively rapid cooling procedure causes undesirable formation of fine cementite particles which cause the ductility of the steel strip to decrease.

The continuously annealed steel strip is overaged at a temperature of from 320° to 450° C. for 1 to 10 minutes. The overaging procedure is effective for promoting the precipitation of carbon and for preventing deterioration of the steel strip by natural aging.

When the overaging temperature is lower than 320° C., carbon exhibits a poor diffusion rate and, therefore, cannot precipitate satisfactorily. Also, at an overaging temperature of more than 450° C., carbon can precipitate rapidly until the content of carbon in the form of solid solution reaches an equilibrium level. However, the equilibrium concentration of the carbon solid solution at the temperature more than 450° C. is relatively large. Therefore, the resultant overaged steel strip contains a large amount of carbon solid solution which causes the undesirable natural aging of the steel strip. Moreover, when the overaging time is less than one minute, the precipitation of carbon is carried out insufficiently. An overaging time over ten minutes does not affect the overaging effect on the steel strip.

The overaged steel strip is cooled to an ambient temperature and the cooled steel strip is temper rolled at the ambient temperature at a desired rolling reduction. Usually, it is preferable that the rolling reduction is in the range of from 0.8% to 1.5%. The temper rolling procedure is effective not only for adjusting the steel strip to the desired form and dimensions, but also, for making the yield point elongation of the steel strip approximately zero and for controlling the quality of the steel strip.

The specific examples presented below will serve to more fully elaborate how the present invention is practiced. However, it should be understood that the examples are only illustrative and in no way limit the scope of the present invention.

EXAMPLES 1 TO 6 AND COMPARISON EXAMPLES 1 TO 6

In each of the Examples 1 to 6 and Comparison Examples 1 to 6, a steel slab having a composition as indicated in Table 1 was prepared by a continuous casting method.

TABLE 1

| | | Composition (% by weight) | | | | | | | | |
|---|---|---|---|---|---|---|---|---|---|---|
| No. | Item | C | Mn | P | Al | N | B | Si | metal | Ca |
| Example | 1 | 0.015 | 0.10 | 0.073 | 0.023 | 0.0018 | — | — | — | — |
| Comparison Example | 1 | 0.015 | 0.10 | 0.045 | 0.025 | 0.0017 | — | — | — | — |
| Example | 2 | 0.015 | 0.10 | 0.053 | 0.023 | 0.0019 | 0.0017 | 0.3 | — | — |
| | 3 | 0.014 | 0.10 | 0.070 | 0.022 | 0.0020 | 0.0017 | — | — | — |
| | 4 | 0.014 | 0.10 | 0.089 | 0.025 | 0.0020 | — | — | — | 0.0014 |
| | 5 | 0.014 | 0.10 | 0.064 | 0.025 | 0.0018 | 0.0020 | — | 0.005 | — |
| Comparison Example | 2 | 0.031 | 0.19 | 0.081 | 0.036 | 0.0024 | — | — | — | — |
| | 3 | 0.019 | 0.62 | 0.078 | 0.033 | 0.0026 | — | — | — | — |
| | 4 | 0.010 | 0.16 | 0.076 | 0.040 | 0.0049 | — | — | — | — |
| | 5 | 0.010 | 0.16 | 0.130 | 0.040 | 0.0039 | — | — | — | — |
| | 6 | 0.002 | 0.43 | 0.092 | 0.036 | 0.0027 | — | — | — | — |
| Example | 6 | 0.013 | 0.15 | 0.067 | 0.026 | 0.0017 | 0.0015 | — | — | — |

The steel slab was heated to a temperature of 1100° C. and the heated steel slab was hot rolled. The hot rolling procedure was finished at a temperature of the resultant steel strip of 930° C. and the resultant steel strip was coiled at a temperature of 680° C. The resultant steel strip had a thickness of 4.0 mm, and pickled.

The descaled steel strip was cold rolled at a rolling reduction of 80% to provide a cold rolled steel strip having a thickness of 0.8 mm.

The cold rolled steel strip was continuously annealed by heating the steel strip to a temperature of 800° C. at a heating rate of 10° C./sec, by allowing it to stand at the temperature of 800° C. for 40 seconds and, then, by cooling it to 650° C. at a cooling rate of 20° C./sec and, then, to 400° C. at a cooling rate of 50° C./sec.

The annealed steel strip was overaged at a temperature of 400° C. for 3 minutes.

The overaged steel strip was cooled to an ambient temperature and the cooled steel strip was temper rolled at the ambient temperature at a rolling reduction of 1.2%.

The mechanical properties of the resultant steel strips in the Examples 1 to 6 and Comparison Examples 1 to 6 are indicated in Table 2.

The tensile test of the steel strips was carried out in accordance with the testing method as defined in Japanese Industrial Standard (JIS) Z 2241 by using test specimens as defined in JIS Z 2201, No. 5.

The ($\bar{r}$) value of each steel strip was measured by using specimens as defined in JIS Z 220, No. 5 and calculated from the equation:

$$\bar{r}=(r_0+2r_{45}+r_{90})/4$$

wherein $r_0$, $r_{45}$ and $r_{90}$ respectively represent r values of the steel specimen in directions with angles of 0, 45 and 90 degrees from the rolling direction applied to the steel strip. The term "r value" refers to the ratio of the logarithmic strain in the width-measured direction of the specimen to a logarithmic strain in the thickness-measured direction of the specimen when a 10% strain is imported to the specimen in the longitudinal direction of the specimen.

TABLE 2

| Example No. | Item | Yield strength (Kgf/mm²) | Tensile strength (Kgf/mm²) | Elongation (%) | (*)1 Yield point elongation (%) | $\bar{r}$ value | (*)2 Intensity of paint-bake hardening (Kgf/mm²) | (*)3 Resistance to planar cracking (°C.) |
|---|---|---|---|---|---|---|---|---|
| Example | 1 | 23.9 | 36.4 | 40 | 0 | 1.73 | 6.2 | −65 |
| Comparison Example | 1 | 19.6 | 33.2 | 42 | 0.2 | 1.79 | 4.7 | <−80 |
| Example | 2 | 24.3 | 40.1 | 36 | 0 | 1.65 | 5.0 | −70 |
| | 3 | 21.8 | 37.0 | 39 | 0 | 1.68 | 6.2 | −63 |
| | 4 | 22.4 | 37.6 | 37 | 0.2 | 1.72 | 5.8 | −54 |
| | 5 | 20.7 | 35.8 | 40 | 0 | 1.73 | 5.6 | −60 |
| Comparison Example | 2 | 26.5 | 41.1 | 35 | 0.2 | 1.39 | 4.8 | −63 |
| | 3 | 23.6 | 39.4 | 37 | 0 | 1.23 | 4.0 | −75 |
| | 4 | 28.1 | 36.3 | 39 | 0.6 | 1.30 | 6.6 | −64 |
| | 5 | 25.6 | 41.7 | 36 | 0.2 | 1.51 | 5.8 | −15 |
| | 6 | 21.7 | 35.3 | 40 | 0.6 | 1.72 | 6.8 | −17 |
| Example | 6 | 22.2 | 36.0 | 40 | 0 | 1.80 | 5.7 | −68 |

Note:
(*)1 - The yield point elongation was measured after the test specimen was artificially aged at a temperature of 100° C. for 60 minutes.
(*)2 - The intensity of the paint-bake hardening was represented by the difference between the flow stress of the specimen when a 2% strain was imported to the specimen and the yield stress of the specimen when a 2% strain was imported to the specimen after heating it at a temperature of 170° C. for 20 minutes.
(*)3 - The resistance to planar cracking was determined in such a manner that a steel strip to be tested was primarily shaped into a cup by applying a deep drawing procedure thereto at a drawing ratio of 2.2. An opening of the cup was placed on a tapered punch and secondarily shaped so that the opening was enlarged. This secondary shaping procedure was repeated at various temperatures. The resistance of the steel strip to planar cracking was represented by the lowest temperature at which no brittle fracture occurs in the opening.

Referring to Table 1, the steel of Comparison Example 1 had 0.045% by weight of phosphorus which is less than the lower limit thereof for the steel useful for the present invention. The steel of Comparison Example 2 had 0.031% by weight of carbon which is more than the upper limit thereof in the steel of the present invention. The steel of Comparison Example 3 had 0.62% by weight of manganese which is larger than the upper limit thereof in the steel of the present invention. The steel of Comparison Example 4 had 0.0049% by weight of nitrogen which is higher than the upper limit thereof in the steel of the present invention. The steel of Comparison Example 5 had 0.130% by weight of phosphorus which is higher than the upper limit thereof in the steel of the present invention. Also, the steel of Comparison Example 6 had 0.002% by weight of carbon which is below the lower limit thereof in the steel of the present invention.

Referring to Table 2, it is clear that the steel strip produced by the process of the present invention exhibited a satisfactory yield strength of 20 to 25 Kgf/mm², a satisfactory tensile strength of 35 to 43 Kgf/mm², a satisfactory ultimate elongation of 35 to 40%, a desirable very low yield point elongation of 0 to 0.2%, a high $\bar{r}$ value of 1.6 or more, a high intensity of paint-bake hardening of about 5 Kgf/mm² and a satisfactory resistance to planar cracking of less than −50° C.

However, the resultant steel strip of Comparison Example 1 having a poor content of phosphorus exhibited a poor tensile strength of less than 35 Kgf/mm² and a poor yield strength of less than 20 Kgf/mm². The resultant steel strips of Comparison Examples 2, 3 and 4 respectively having excessively large contents of carbon, manganese and nitrogen exhibited poor $\bar{r}$ values of less than 1.6. Also, the steel strip of Comparison Example 4 exhibited an excessively large yield point elongation of 0.6%. The product of Comparison Example 5 containing an excessively large amount of phosphorus exhibited a poor resistance to planar cracking. The product of Comparison Example 6 containing an excessively small amount of carbon exhibited a poor resistance to planar cracking and a large yield point elongation.

EXAMPLES 7 TO 11 AND COMPARISON EXAMPLES 7 TO 15

In each of Examples 7 to 11 and Comparison Examples 7 to 15, a steel slab having the same composition as that of Example 6 was processed as indicated in Table 3.

TABLE 3

| | | Heating and hot rolling | | | | Cold rolling | | Continuous annealing | | | Overaging | | Temper rolling |
|---|---|---|---|---|---|---|---|---|---|---|---|---|---|
| Example No. | Item | Heating temperature (%) | Hot rolling finishing temperature (%) | Coiling temperature (%) | Thickness of hot rolled strip (mm) | Thickness of cold rolled strip (mm) | Rolling reduction (%) | Annealing temperature (°C.) | Time (sec) | Cooling rate* (°C./sec) | Temperature (°C.) | Time (min) | Rolling reduction (%) |
| Example | 7 | 1100 | 930 | 680 | 4.0 | 0.8 | 80 | 850 | 40 | 50* | 400 | 3 | 1.2 |
| | 8 | 1100 | 930 | 680 | 4.0 | 0.8 | 80 | 800 | 40 | 50* | 400 | 3 | 1.2 |
| | 9 | 1100 | 930 | 680 | 4.0 | 0.8 | 80 | 750 | 40 | 50* | 400 | 3 | 1.2 |
| | 10 | 1100 | 930 | 680 | 4.0 | 0.8 | 80 | 700 | 40 | 50* | 400 | 3 | 1.2 |
| Comparison Example | 7 | 1100 | 930 | 680 | 4.0 | 0.8 | 80 | 650 | 40 | 50 | 400 | 3 | 1.2 |
| Example | 11 | 1100 | 930 | 680 | 2.9 | 1.0 | 65.5 | 800 | 40 | 50* | 400 | 3 | 1.2 |
| Comparison | 8 | 1100 | 930 | 680 | 2.9 | 1.1 | 62.1 | 800 | 40 | 50* | 400 | 3 | 1.2 |

TABLE 3-continued

| Example No. | Item | Heating and hot rolling: Heating temperature (%) | Hot rolling finishing temperature (%) | Coiling temperature (%) | Thickness of hot rolled strip (mm) | Cold rolling: Thickness of cold rolled strip (mm) | Rolling reduction (%) | Continuous annealing: Annealing temperature (°C.) | Time (sec) | Cooling rate* (°C./sec) | Overaging: Temperature (°C.) | Time (min) | Temper rolling: Rolling reduction (%) |
|---|---|---|---|---|---|---|---|---|---|---|---|---|---|
| Example | 9 | 1300 | 930 | 630 | 4.0 | 0.8 | 80 | 800 | 40 | 50* | 400 | 3 | 1.2 |
| | 10 | 1100 | 930 | 680 | 4.0 | 0.8 | 80 | 930 | 60 | 50* | 400 | 4 | 1.2 |
| | 11 | 1100 | 930 | 680 | 4.0 | 0.8 | 80 | 800 | 40 | 0.5 | 400 | 3 | 1.2 |
| | 12 | 1100 | 930 | 680 | 4.0 | 0.8 | 80 | 750 | 0 | 50* | 400 | 3 | 1.2 |
| | 13 | 1100 | 930 | 680 | 4.0 | 0.8 | 80 | 800 | 40 | 50* | 300 | 3 | 1.2 |
| | 14 | 1100 | 930 | 680 | 4.0 | 0.8 | 80 | 800 | 40 | 50* | 480 | 3 | 1.2 |
| | 15 | 1100 | 810 | 650 | 4.0 | 0.8 | 80 | 800 | 40 | 50* | 480 | 3 | 1.2 |

Note:
*The cooling procedure was carried out to 650° C. at a cooling rate of 10° C./sec, and then to the overaging temperature at a cooling rate indicated in Table 3.

Referring to Table 3, the annealing temperature in Comparison Example 7 was below 700° C. which is a lower limit of the annealing temperature of the present invention. In Comparison Example 8, the cold rolling reduction was below 65% which is the lower limit thereof in the process of the present invention. In Comparison Example 9, the heating temperature for the hot rolling procedure was above 1200° C. which is the upper limit thereof in the process of the present invention. The Comparison Example 10, the annealing temperature was above 900° C. which is an upper limit thereof in the process of the present invention. In Comparison Example 11, the cooling rate in the annealing procedure is significantly smaller than 5° C./sec which is the lower limit thereof in the process of the present invention. In Comparison Example 12, when the steel strip reached an annealing temperature of 750° C., the steel strip was immediately cooled without allowing it to stand at the annealing temperature. In Comparison Example 13, the overaging temperature was below 320° C. which is the lower limit thereof in the process of the present invention. In Comparison Example 14, the overaging temperature was above 450° C. which is the upper limit thereof in the process of the present invention. In Comparison Example 15, the hot rolling procedure was finished at a temperature of 810° C. which was below the $Ar_3$ point of the steel slab.

The properties of the resultant steel strips in Examples 7 to 11 and Comparison Examples 1 to 15 are indicated in Table 4.

Referring to Table 4, the products of Comparison Examples 7, 10 and 12 in which the annealing procedures were carried out under conditions outside the scope of the present invention, exhibited a poor $\bar{r}$ values of less than 1.6 and an undesirable large yield point elongation. The products of Comparison Examples 9 and 15 in which the hot rolling procedures were carried out at temperatures outside the scope of the present invention, exhibited a poor $\bar{r}$ value. The product of Comparison Example 9 exhibited an undesirably large yield point elongation and poor resistance to planar cracking. The products of Comparison Example 8 in which the cold rolling reduction is less than 65%, exhibited a poor $\bar{r}$ value. The product of Comparison Example 11 in which the cooling rate in the continuous annealing procedure was significantly low, and the products of Comparison Examples 13 and 14 in which the overaging temperatures were outside the scope of the present invention, exhibited undesirably large yield point elongations which correspond to large deterioration of the products by natural aging.

However, the products of Examples 7 to 11 in accordance with the process of the present invention each exhibited satisfactory yield strength, tensile strength, yield point elongation, $\bar{r}$ value, paint-baked hardening property and resistance to planar cracking. It should be noted that the products of the present invention exhibited both excellent mechanical strength and superior resistances to natural aging and to planar cracking.

We claim:

TABLE 4

| Example No. | Item | Yield strength ($Kgf/mm^2$) | Tensile strength ($Kgf/mm^2$) | Elongation (%) | Yield point elongation (%) | $\bar{r}$ value | Intensity of paint-bake hardening ($Kgf/mm^2$) | Resistance to planar cracking (°C.) |
|---|---|---|---|---|---|---|---|---|
| Example | 7 | 20.9 | 35.7 | 40 | 0 | 1.81 | 5.3 | −61 |
| | 8 | 22.2 | 36.0 | 40 | 0 | 1.80 | 5.7 | −68 |
| | 9 | 23.4 | 37.8 | 39 | 0 | 1.72 | 5.8 | −60 |
| | 10 | 23.9 | 38.4 | 37 | 0.2 | 1.70 | 5.3 | −60 |
| Comparison Example | 7 | 26.5 | 41.4 | 34 | 0.4 | 1.42 | 4.9 | −36 |
| Example | 11 | 21.7 | 36.1 | 39 | 0 | 1.60 | 5.5 | −67 |
| Comparison Example | 8 | 21.0 | 36.2 | 38 | 0 | 1.31 | 6.0 | −66 |
| | 9 | 25.3 | 40.0 | 36 | 0.4 | 1.31 | 6.2 | −30 |
| | 10 | 22.7 | 37.8 | 38 | 0.2 | 1.03 | 5.7 | −70 |
| | 11 | 22.1 | 37.6 | 38 | 0.6 | 1.76 | 6.1 | −68 |
| | 12 | 28.3 | 42.1 | 34 | 0.4 | 1.39 | 6.8 | −58 |
| | 13 | 23.7 | 37.7 | 37 | 1.2 | 1.67 | 6.9 | −60 |
| | 14 | 24.6 | 38.1 | 36 | 1.0 | 1.67 | 7.1 | −56 |
| | 15 | 20.0 | 35.1 | 37 | 0 | 1.23 | 5.6 | −61 |

1. A process for producing a high strength cold rolled steel strip useful for motor vehicles, comprising the steps of:

preparing a steel slab comprising
0.008 to 0.020% by weight of carbon,
0.01 to 0.45% by weight of manganese,
0.05 to 0.10% by weight of phosphorus,
0.005 to 0.050% by weight of acid-soluble aluminum,
and the balance consisting of iron and unavoidable impurities in which nitrogen is limited to a content of 40 ppm or less;

heating said steel slab to a temperature of 1200° C. or less;

hot rolling said heated steel slab at a temperature not lower than the $Ar_3$ point of said steel;

descaling said resultant hot rolled steel strip;

cold rolling said descaled steel strip at a rolling reduction of 65% or more;

continuously annealing said cold rolled steel strip by heating it to a temperature of from 700° to 900° C., by soaking the steel strip for 20 seconds to 3 minutes and by cooling the steel strip at a cooling rate of from 5° C./sec to 30° C./sec in the temperature range of 650° C. or more and then, at a cooling rate of more than 30° C./sec in the temperature range of below 650° C.;

overaging said annealed steel strip at a temperature of from 320° to 450° C. for 1 to 10 minutes;

cooling said overaged steel strip to the ambient temperature, and;

temper-rolling said cooled steel strip at the ambient temperature.

2. The process as claimed in claim 1, wherein said steel slab contains an optional alloying component consisting of at least one member selected from the group consisting of 0.0005 to 0.0050% by weight of boron, 0.5% by weight or less of silicon, 0.005 to 0.020% by weight of at least one earth metal and 0.0005 to 0.0050% by weight of calcium.

3. The process as claimed in claim 1, wherein the steel slab is heated to a temperature of from 1000° to 1200° C.

4. The process as claimed in claim 1, wherein the cold rolling procedure is carried out at a rolling reduction of from 65 to 90%.

5. The process as claimed in claim 1, wherein said temper rolling procedure is carried out at a rolling reduction of from 0.8 to 1.5%.

* * * * *